US012623110B1

(12) United States Patent
Vinopal

(10) Patent No.: US 12,623,110 B1
(45) Date of Patent: May 12, 2026

(54) VARIABLE WEIGHT EXERCISE EQUIPMENT

(71) Applicant: Timothy Vinopal, Canfield, OH (US)

(72) Inventor: Timothy Vinopal, Canfield, OH (US)

( * ) Notice: Subject to any disclaimer, the term of this patent is extended or adjusted under 35 U.S.C. 154(b) by 388 days.

(21) Appl. No.: 17/900,735

(22) Filed: Aug. 31, 2022

Related U.S. Application Data

(60) Provisional application No. 63/242,207, filed on Sep. 9, 2021.

(51) Int. Cl.

| | |
|---|---|
| ***A63B 21/06*** | (2006.01) |
| ***A63B 21/00*** | (2006.01) |
| ***A63B 21/072*** | (2006.01) |
| ***A63B 21/075*** | (2006.01) |

(52) U.S. Cl.
CPC ..... *A63B 21/0603* (2013.01); *A63B 21/0724* (2013.01); *A63B 21/075* (2013.01); *A63B 21/4035* (2015.10)

(58) Field of Classification Search
CPC ..... A63B 21/0603; A63B 21/0724; A63B 21/4035; A63B 21/06; A63B 21/0602; A63B 21/0004; A63B 21/0726; A63B 21/072–075
See application file for complete search history.

(56) References Cited

U.S. PATENT DOCUMENTS 2,616,467 A 11/1952 Cicero
2,669,272 A 2/1954 Permann
4,602,784 A * 7/1986 Budden ..... A63B 21/065 482/105
5,492,320 A * 2/1996 Hoffman ..... A63B 67/06 473/594
6,149,555 A 11/2000 Kinback
6,149,557 A 11/2000 Williams et al.
(Continued)

FOREIGN PATENT DOCUMENTS

EP 3444015 2/2019
KR 101233360 B1 * 2/2023 ..... A63B 21/075

OTHER PUBLICATIONS

Mills document (derived from: Jason Mills, "Mesh Fabrics: Knitting and Finishing Nylon and Polyester Mesh and Netting" [online], Nov. 11, 2019 [retrieved on Sep. 29, 2024], Retrieved from: https://www.jasonmills.com/blog/mesh-fabrics/#:~:text=Mesh%20Fabric%20Properties,Tear%20resistance) (Year: 2019).*
(Continued)

*Primary Examiner* — Megan Anderson
*Assistant Examiner* — Catrina A Letterman
(74) *Attorney, Agent, or Firm* — John Rizvi; John Rizvi, P.A.—The Patent Professor ®

(57) ABSTRACT

A weight assembly includes a shell having a pair of opposing half sections that cooperatively define an interior enclosure space. The shell houses a set of circumferentially spaced-apart and axially extending partition elements that span between and connect the pair of opposing shell half sections. The partition element includes a pair of opposing radial edges that connect to the pair of shell half sections. A compartment space is defined by each pair of adjacent partition elements. The mass of the weight assembly can be variably adjusted by loading an appropriate amount of fill material such as sand into the set of isolated compartment spaces.

13 Claims, 11 Drawing Sheets

(56) References Cited

U.S. PATENT DOCUMENTS

| | | | | |
|---|---|---|---|---|
| 6,224,517 | B1 | 5/2001 | Dereszynski | |
| 8,454,483 | B1 | 6/2013 | Bradley et al. | |
| 10,149,997 | B1 | 12/2018 | Henniger et al. | |
| 10,252,097 | B1 * | 4/2019 | Raines | E02B 3/127 |
| 10,561,885 | B1 * | 2/2020 | Lewis, Jr. | A63B 21/0603 |
| 2005/0187075 | A1 | 8/2005 | Bellamy | |
| 2011/0287904 | A1 | 11/2011 | Morris | |
| 2015/0165258 | A1 * | 6/2015 | Januszek | A63B 21/06 482/93 |
| 2017/0189735 | A1 * | 7/2017 | Buikema | A63B 21/0603 |
| 2018/0085619 | A1 * | 3/2018 | Chen | A63B 23/12 |
| 2019/0111304 | A1 * | 4/2019 | Gilman | A63B 23/0405 |
| 2019/0184252 | A1 * | 6/2019 | Raines | A63B 41/085 |
| 2020/0206557 | A1 * | 7/2020 | Poeta, IV | A63B 21/0603 |
| 2023/0256287 | A1 * | 8/2023 | Allen | A63B 21/072 482/93 |
| 2024/0139574 | A1 * | 5/2024 | Diguardi | A63B 21/0603 |
| 2025/0001233 | A1 * | 1/2025 | Perez | A63B 21/0603 |

OTHER PUBLICATIONS

Translation of KR-101233360-B1 (Year: 2013).*

* cited by examiner

VARIABLE WEIGHT EXERCISE EQUIPMENT

CROSS-REFERENCE TO RELATED APPLICATIONS

This application claims the benefit of U.S. Provisional Patent Application Ser. No. 63/242,207, filed on Sep. 9, 2021, which is incorporated herein in its entirety.

FIELD OF THE INVENTION

The present invention relates generally to weight training equipment, and, more particularly, to a free-weight plate designed to accommodate a variable amount of weighted contents to offer different levels of poundage.

BACKGROUND OF THE INVENTION

Obesity is one of the major health issues that result in numerous diseases, specifically in increasing the risk of certain types of cancer, heart diseases, such as coronary artery disease, diabetes type two, strokes, and other mortality-related ailments, not to mention the economic costs associate with their treatment. Indeed, the United States has a prevailing issue with obesity, with about forty percent of the population falling within the margin. As a result, our healthcare systems are saturated with patients who suffer from ailments derived from a poor diet and lack of exercise.

Consequently, the healthcare community has been for years promoting healthier lifestyles to the public. Hospitals, clinics, and the like have served and continue to educate the public about staying healthy year-round to avoid injuries or illnesses derived from preventable behaviors. Many insurance companies have joined the movement too by creating incentive programs for their members. For instance, to reduce deductible payments for individuals, the member can track their healthy eating patterns and catalog their exercise routines. The more the person exercises and eats healthy consistently, the lower their deductible would be in the unfortunate event they have to be hospitalized.

Gym memberships in 2019 exceeded more than sixty million members. However, the sudden and unexpected surgence of COVID-19 changed everything. The gyms closed, and home exercise equipment disappeared off the shelves as people wanted to continue to exercise. The lack of equipment available to the public was not the only problem. The costs associated with home gym equipment were astronomical, and many could not afford the equipment to continue their healthy lifestyles. For instance, when performing bench press exercises, the person may want to modulate the weight by adding weight plates or removing weight plates to the bar. However, each plate is expensive, and obtaining a varied set of weight plates to modulate weight when exercising is difficult to do.

Accordingly, there is an established need for a weight assembly useful in weightlifting applications that features a variable capacity to adjust the load to a desired weight amount. The weight assembly can be used to perform different exercises at varied weights.

SUMMARY OF THE INVENTION

The present invention is directed to an exercise-type weight assembly including a hollow shell structure having a pair of matching and opposing half-sections that cooperatively define an interior enclosure space. The shell has a generally circular or disc shape. The shell has a central aperture to receive a barbell. The weight assembly includes a plurality of barrier-type partition elements disposed in the enclosure space of the shell and which extend between the pair of shell half sections. The partition elements are circumferentially spaced-apart and extend in a radial direction. In one form, the partition element has a trapezoidal or rectangular construction in which the legs form the connection to the respective pair of shell half sections and in which the bases define an outer radial end and an inner radial end. In another form, the partition element has a rectangular construction. In a preferred form, the partition tapers from its outer radial end to its inner radial end. The outer radial end of the partition element lies proximate the periphery of the shell and the inner radial end lies proximate the central aperture. Each angularly or circumferentially adjacent pair of partition elements defines an intermediate compartment space where weighted contents are loaded, such as sand. Each compartment space is preferably filled with an equal amount of sand to create a loaded weight assembly corresponding to a certain mass and functioning as a weight plate. The weight assembly is equipped with a set of handles around the shell periphery. The weight assembly enables variable loading of the compartment spaces to create different weight levels for the assembly. Each compartment space is preferably associated with a sealable slot formed in the shell periphery. The slot is provided in communication with the compartment space and enables access to the compartment space to fill and empty it as needed. The mass of the weight assembly can be variably adjusted by changing and otherwise modifying the amount of contents loaded into the set of compartment spaces.

Introducing a first embodiment of the invention, the present invention consists of an exercise weight assembly, comprising:

- a generally disc-shaped, hollow shell including a pair of opposing half sections cooperatively defining an interior enclosure space;
- a generally central aperture formed in the shell;
- a plurality of radially extending, circumferentially spaced-apart partition elements disposed in the enclosure space and extending between the pair of half sections; and
- a plurality of compartment spaces each defined by a circumferentially adjacent pair of the partition elements;
- wherein each partition element extends in a radial direction from an inner radial end thereof proximate the central aperture to an outer radial end thereof proximate a periphery of the shell.

In a second aspect, each partition element tapers from the outer radial end thereof to the inner radial end thereof.

In another aspect, the shell has a flexible construction.

In another aspect, the weight assembly further includes at least one handle disposed proximally the periphery of the shell.

In yet another aspect, the weight assembly further includes at least one sealable opening formed in the periphery of the shell and arranged in communication with a respective one of the compartment spaces.

In yet another aspect, each partition element has a flexible construction. In one form, each partition element has a mesh structure.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a weight assembly that accommodates a variable amount of weighted contents to offer different levels of poundage. The mass can be adjusted by loading an appropriate amount of fill material (sand) into a set of adjacent and isolated compartment spaces formed in the interior enclosure space of a flexible shell construction. The shell houses a plurality of circumferentially spaced-apart and axially extending barrier-type partition elements that span between and connect a pair of opposing half sections that define the shell. The partition element includes a pair of opposing radial edges that connect to the pair of shell half sections.

Figure 1:
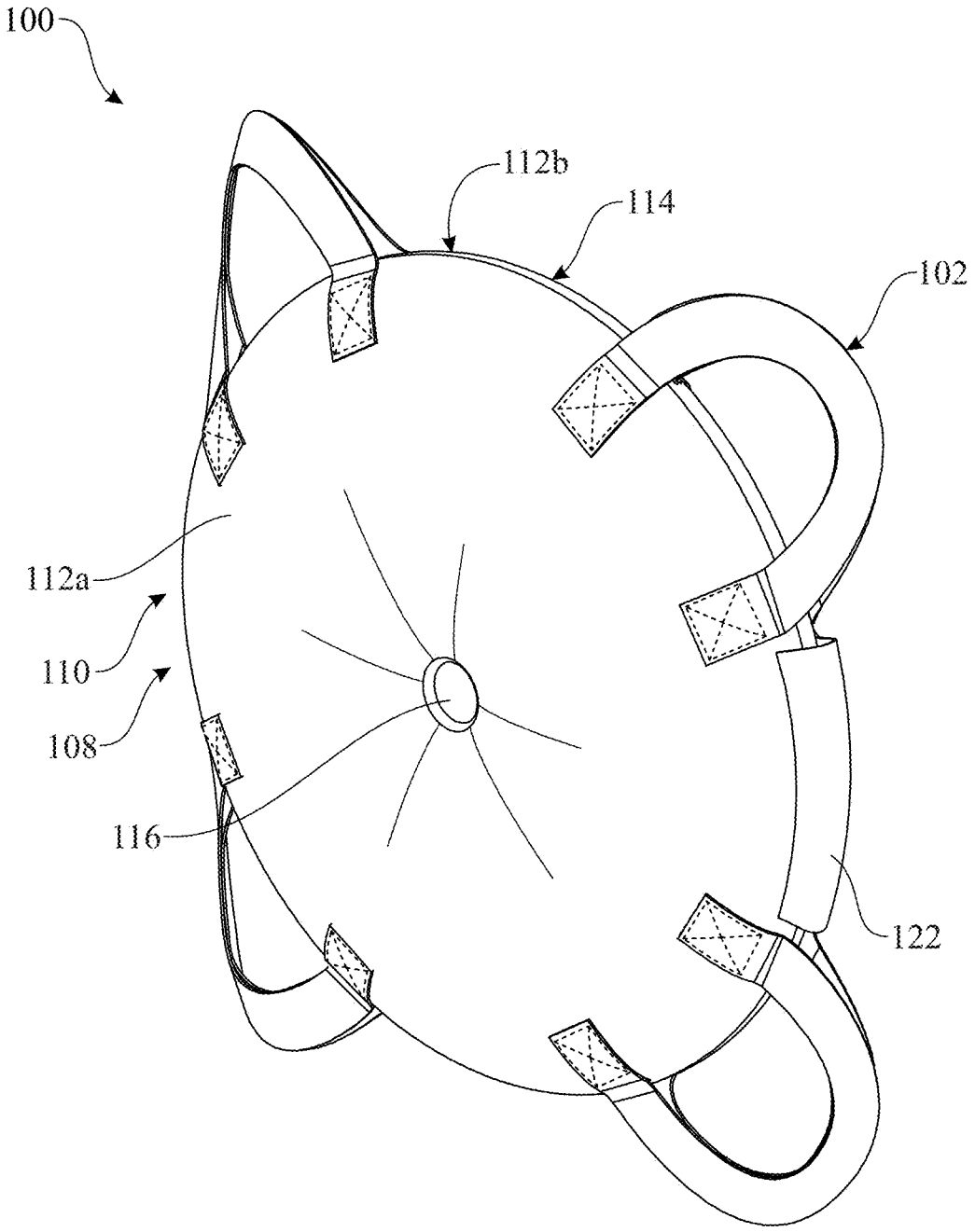
FIG. 1 presents a front perspective view showing a first embodiment of the weight assembly of the present invention.

Referring initially to FIG. 1, an exercise-ready, barbell-type weight assembly or structure 100 is disclosed, according to a first embodiment of the present invention. The structure 100 includes a generally circular, disc-shaped, annular body 108. The body 108 includes a hollow shell or housing 110 including a pair of matching and opposing half sections 112*a,b* cooperatively defining an interior enclosure space. The structure 100 forms a weight plate or other such suitable construction capable of use as a free-weight in a weightlifting or weight-training application. A central aperture or through-hole 116 is formed in body 108, in order to accommodate a barbell. The shell 110 includes a circumferential periphery 114. A set of individual handles 102 are disposed in spaced-apart relationship about the periphery 114 of body 108 to facilitate holding, maneuvering, and other such handling of structure 100, particularly during a weight-training exercise. As discussed herein, the weight assembly 100 is capable of selectively adjusting the amount of mass it carries in order to provide a variable-mass free-weight barbell plate. The weight adjustment is made by varying the amount of contents loaded into individual interior compartment spaces configured in the shape of circle-type sector formations.

Figure 8:
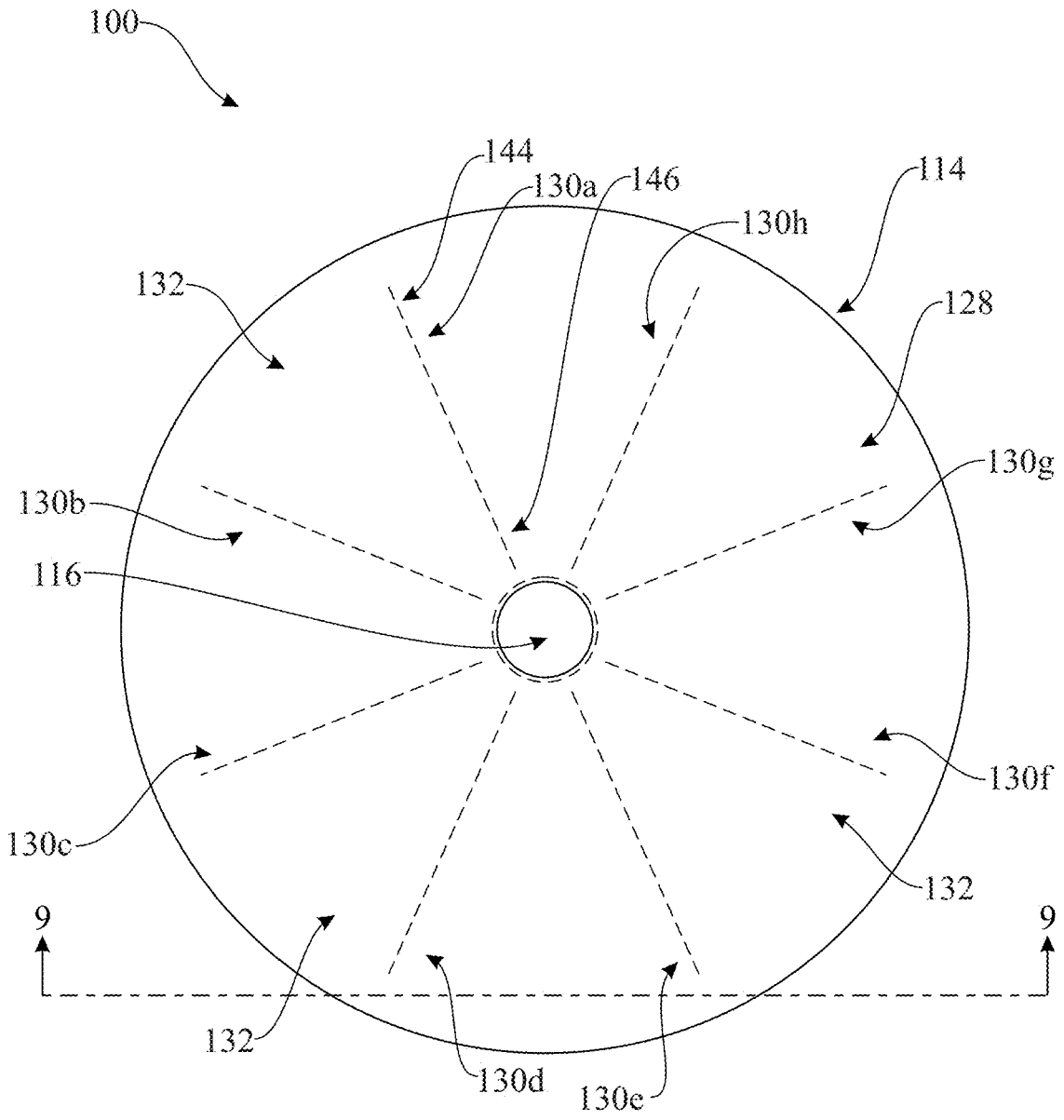
FIG. 8 presents a front elevation view of the first embodiment of the weight assembly of the present invention, illustrating with hidden lines a representative set of interior compartments housing a load of weighted contents such as sand.
Figure 9:
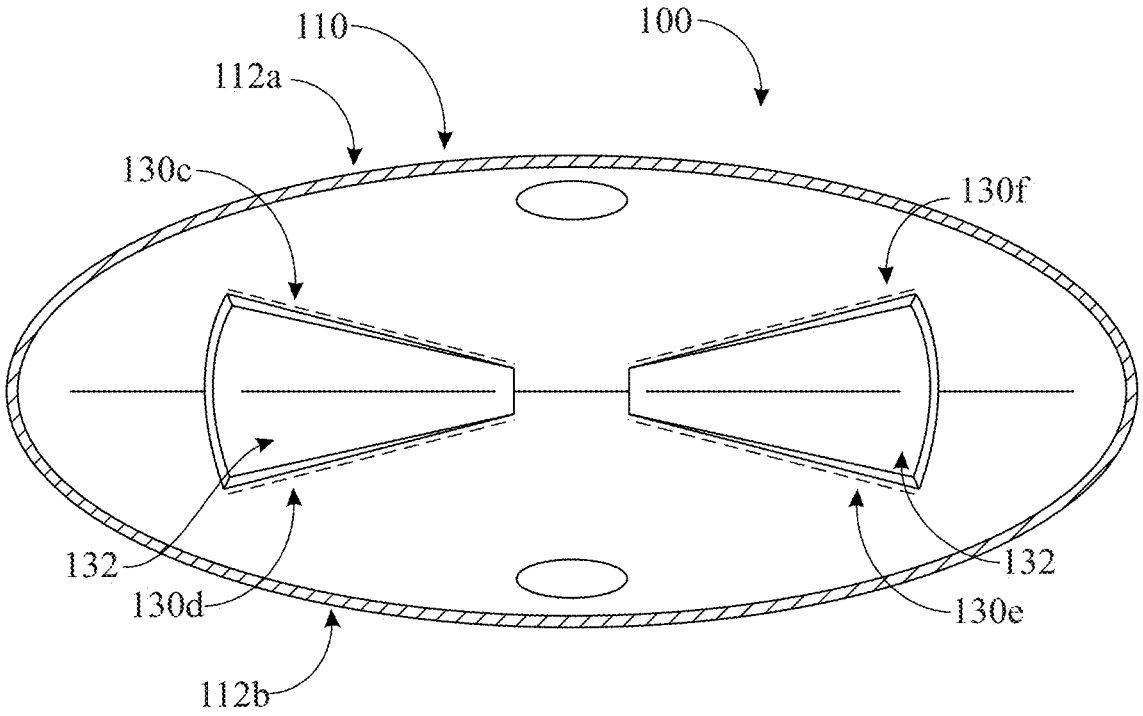
FIG. 9 presents a cross-sectional view taken along secant line 9-9 of FIG. 8, illustrating a representative set of interior compartments of the weight assembly.
Figure 10:
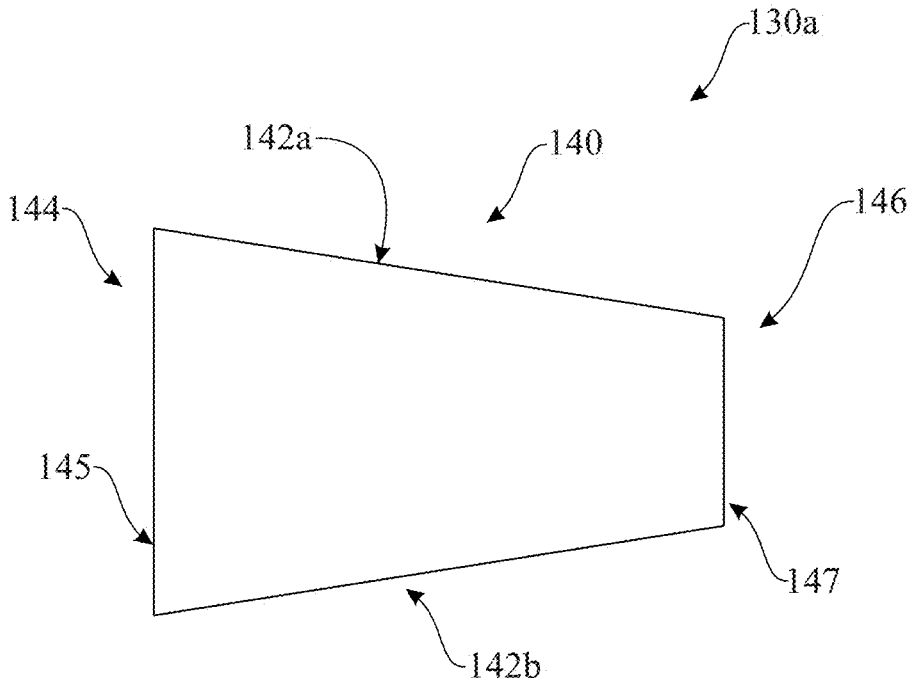
FIG. 10 presents a side elevation view of a representative partition element used in the first embodiment of the weight assembly of the present invention; and, FIG. 11 presents a side elevation view of a representative rectangular partition element used in an embodiment of the weight assembly of the present invention.

Referring now to FIGS. 8-10, with continuing reference to FIG. 1, the structure 100 includes a set of radially extending and circumferentially spaced-apart partition elements or barrier-type wall features generally illustrated at 128, which are disposed at the interior enclosure space of shell 110 of body 108. In the implementation shown, the set 128 includes eight (8) equally spaced barrier-type partition elements 130*a,b,c,d,e,f,g,h* each disposed at a particular angular position about central aperture 116. Each one of the partition elements 130*a-h* of set 128 extends between the pair of half sections 112*a,b* that define shell 110 of body 108, effectively forming a bridge or connection between the pair of half sections 112*a,b* at the interior enclosure space of shell 110. In an alternative form, the spaced-apart partition elements may be disposed within the shell 110 of body 108 in alternative positions extending vertically, horizontally, or diagonally from one half-section to another without sacrificing the structural integrity of structure 100.

As shown and disclosed herein, the weight assembly 100 includes shell 110 having a pair of opposing half sections 112*a,b* that cooperatively define an interior enclosure space. The shell 110 houses a set of circumferentially spaced-apart and axially extending partition elements 130*a-h* that span between and connect the pair of opposing shell half sections 112*a,b*. As discussed further, the partition element 130*a* includes a pair of opposing radial edges that connect to the pair of shell half sections 112*a,b* A compartment space 132 is defined by each pair of adjacent partition elements. The mass of the weight assembly 100 can be variably adjusted by loading an appropriate amount of fill material such as sand into the set of isolated compartment spaces 132.

Figure 11:
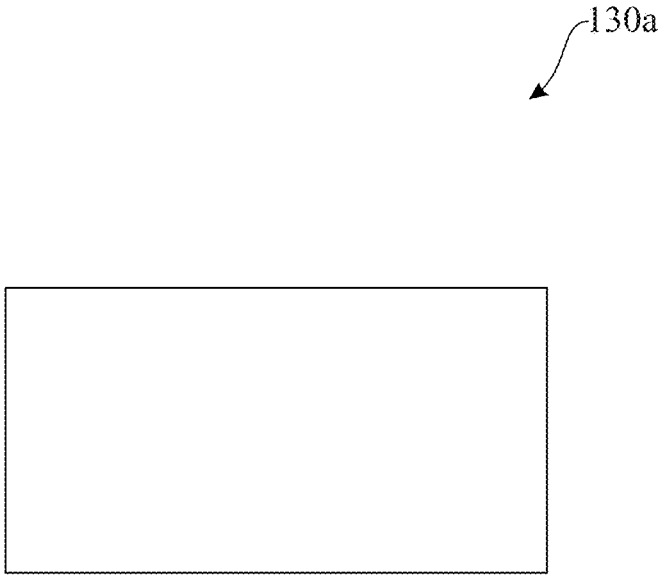

Referring to FIG. 10, the representative partition element 130*a* includes a body 140 extending between a radially inner end 146 and a radially outer end 144. In the assembled installation of partition element 130*a*, its radially inner end 146 lies proximate the central aperture 116, while the radially outer end 144 lies proximate the outer periphery 114 of shell 110. The body 140 includes a pair of radially extending edges 142*a,b* that respectively connect to an inner face of a respective one of the half-sections 112*a,b* of shell 110. For example, edge 142*a* connects along its full length to the inner face of half-section 112*a*, while edge 142*b* connects along its full length to the inner face of half-section 112*b*. In this way, each partition element 130*a-h* spans, connects, and otherwise extends between the pair of half-sections 112*a,b* of shell 110 of body 108. The outer radial end 144 terminates at a terminal edge 145, while the inner radial end 146 terminates at a terminal edge 147. In one form, the terminal edges 145, 147 are parallel to one another, so that body 140 of partition element 130*a* has the form or configuration of a trapezoid (or in some cases, rectangular). In this formation, the partition element 130*a* tapers from the outer radial end 144 to the inner radial end 146. In this particular geometric form, the partition element 130*a* has a trapezoidal construction in which the legs (edges 142*a,b*) form the connection or attachment to the respective pair of opposing shell half sections 112*a,b* and in which the bases (edges 145, 147) define an outer radial end and an inner radial end. In a preferred form, the partition tapers from its outer radial end 144 to its inner radial end 146. The outer radial end 144 of the partition element 130*a* lies proximate the periphery of the shell 110 and the inner radial end 146 lies proximate the central aperture 116. Referring now to FIG. 11, there is provided a rectangular partition element 130*a*. The selection of eight (8) partition elements 130*a-h* is merely for illustrative purposes and should not be considered in limitation of the present invention, as any number of partition elements 130*a* can be used.

Referring specifically to FIG. 8, each angularly adjacent pair of partition elements 130*a-h*, such as partition elements 130*a,b*, define an intermediate compartment space or pocket 132 between them. As discussed further, each compartment space 132 is filled with a solid material or substance such as sand, effectively making each compartment space 132 a storage area for receiving an equally weighted load amount that cumulatively produce a desired overall mass for the weight assembly 100. Each partition element 130*a* can be constructed in a manner conducive to building a barbell plate in the form of weight assembly 100. In particular, each partition element 130*a* is designed to hold weighted contents in a manner facilitating an equal and stable distribution of mass around the central aperture 116. In one form, for example, each partition element 130*a* has a flexible, pliable (non-rigid) construction, such as a mesh structure. Similarly, the shell 110 of body 108 preferably has a flexible, pliable (non-rigid) construction, such as a synthetic rubber material (e.g., neoprene). The partition element 130*a* preferably has a flexible construction, such as a mesh-type composition or article. In its deployed state, when the relevant compartment space 132 is filled with contents (e.g., sand), each individual partition element 130*a* assumes a generally planar, elongate form that supports and retains the loaded contents. Due to its flexible properties, the partition element 130*a* may generally conform to the volume of sand. In one exemplary embodiment, the openings in the mesh construction are smaller than weighted material particles, or sand particles, such that they cannot traverse through the mesh and move from one compartment to another.

The permeability of partition element 130*a* may be appropriately selected in order to prevent contents in one compartment space 132 from migrating or communicating to an adjacent compartment space 132, thereby retaining the contents loaded into the original compartment space 132. Additionally, the partition element 130*a* can be sized, dimensioned, and otherwise configured to create a compartment space 132 that is isolated from any adjacent compartment space 132, preventing the communication of loaded contents (e.g., sand) from one compartment 132 to another. In one form, for example, the partition element 130*a* extends the full radial dimension from the central aperture 116 to the shell periphery 114. Other features are possible within the scope of the invention. Any suitable material or fabric can be used to construct weight assembly 100. In one form, for example, the shell 110 is made of an impermeable material suitable to prevent the contents loaded into the various compartments spaces 132 (e.g., sand) from escaping weight assembly 100. For example, the shell 110 is made out of reinforced material capable of supporting and retaining weighted material therein. Additionally, the partition element 130*a* may be made of a suitable impermeable material configured to hold the stored contents (e.g., sand) within the relevant compartment space 132 and to prevent their escape or communication into adjacent compartment spaces 132, effectively functioning as a barrier to prevent the loaded contents (sand) from shifting around from one compartment to another.

Figure 2:
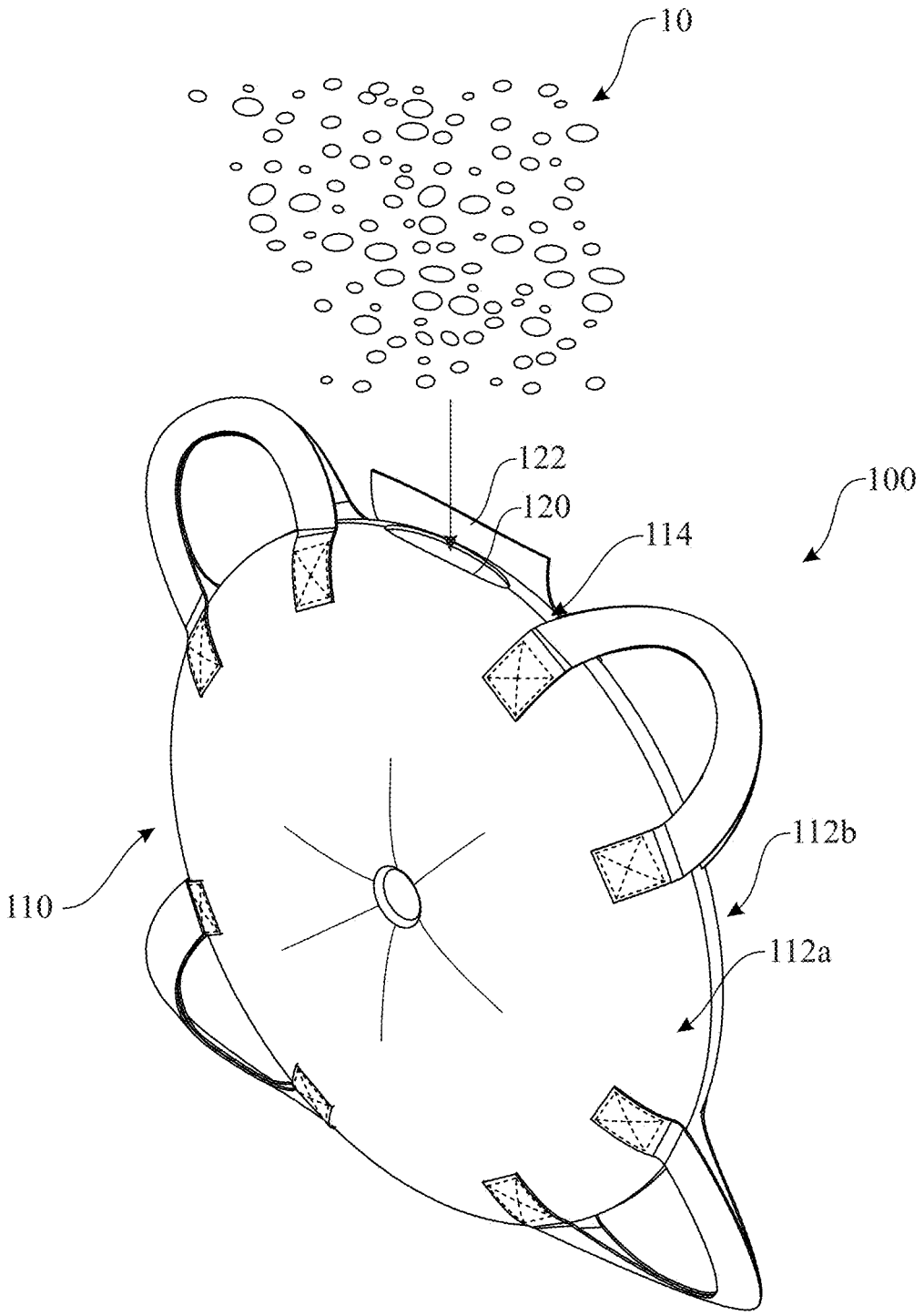
FIG. 2 presents a front perspective view of the first embodiment of the weight assembly of the present invention, illustrating how a sealable slot formed in the periphery of the weight assembly is accessed to fill one of the interior compartments with sand.
Figure 7:
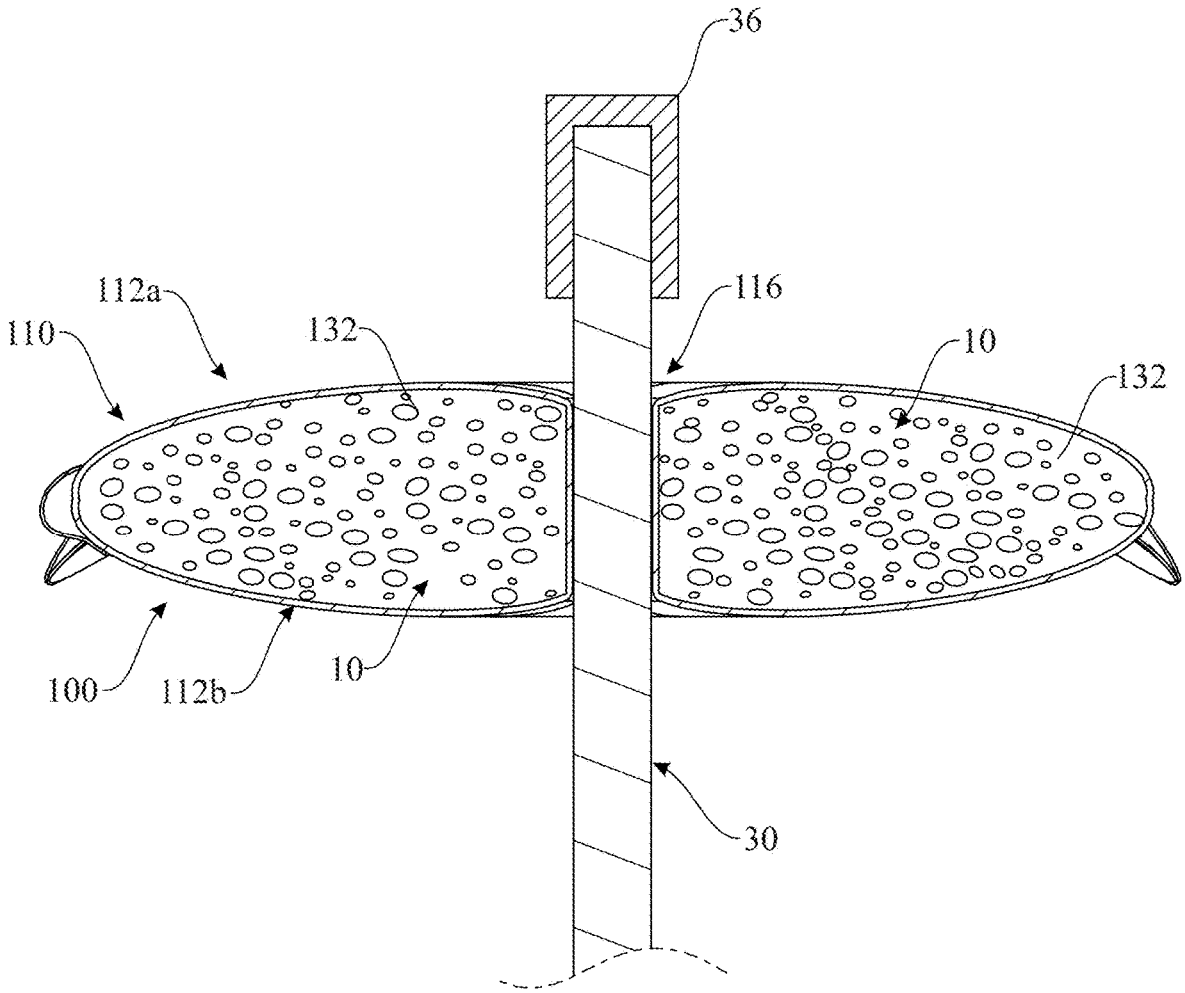
FIG. 7 presents a cross-sectional view taken along diametric line 7-7 of FIG. 5, illustrating how a representative set of diametrically opposed interior compartments of the weight assembly are filled with sand.

Referring now to FIGS. 1-2 and 7, the weight assembly 100 incorporates a means to access each interior compartment space 132 to fill it with sand. In one form, for example, the periphery 114 of shell 110 includes a circumferential sand-filling slot, mouth or opening 120 that is sealed with a flap or covering 122. The peripheral slot 120 is arranged for material communication with a respective compartment space 132. Various other configurations are possible. For example, the shell periphery 114 can be provided with a corresponding circumferential slot 120 associated with each compartment space 132, so that each such space 132 can be independently filled with sand 10 through its own dedicated fill slot 120 (FIG. 2). Any suitable means known to those skilled in the art can be used to seal the slot 120 in addition to the disclosed flap-type cover 122, such as a fastener, closure mechanism, zipper, or other suitable re-sealable feature. Each compartment space 132 is filled via its corresponding slot 120 with an appropriate amount of sand 10 depending on the desired weight of weight assembly 100 (FIG. 7). Any suitable material can be used to occupy the compartment space 132 and provide the loading or weighting functionality. The disclosure of sand as a fill material is merely for illustrative purposes only and should not be considered in limitation of the invention.

Figure 3:
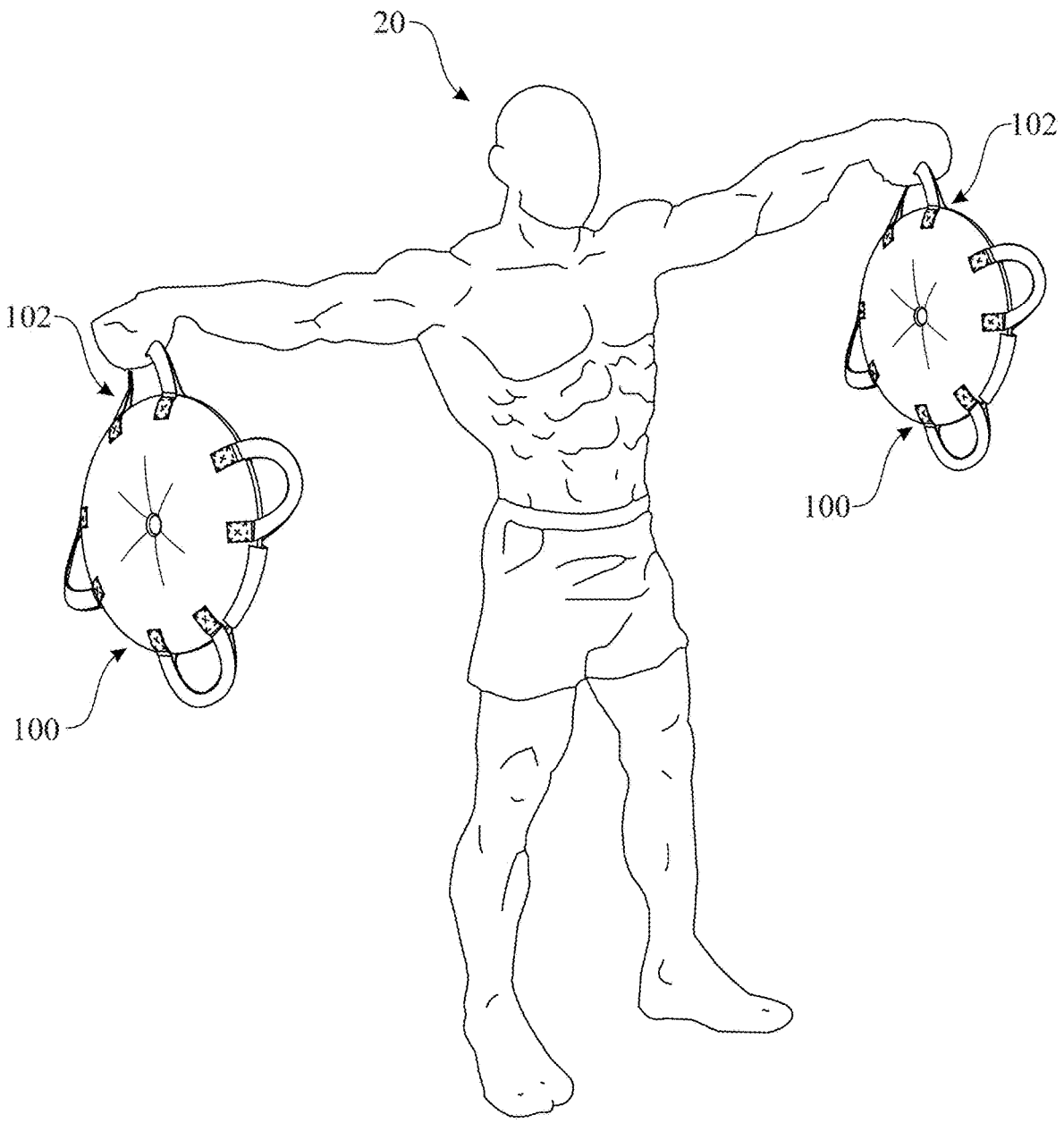
FIG. 3 presents a front perspective showing a user in a standing position exercising with the weight assembly according to the first embodiment of the present invention, holding one in each hand as a free weight.
Figure 4:
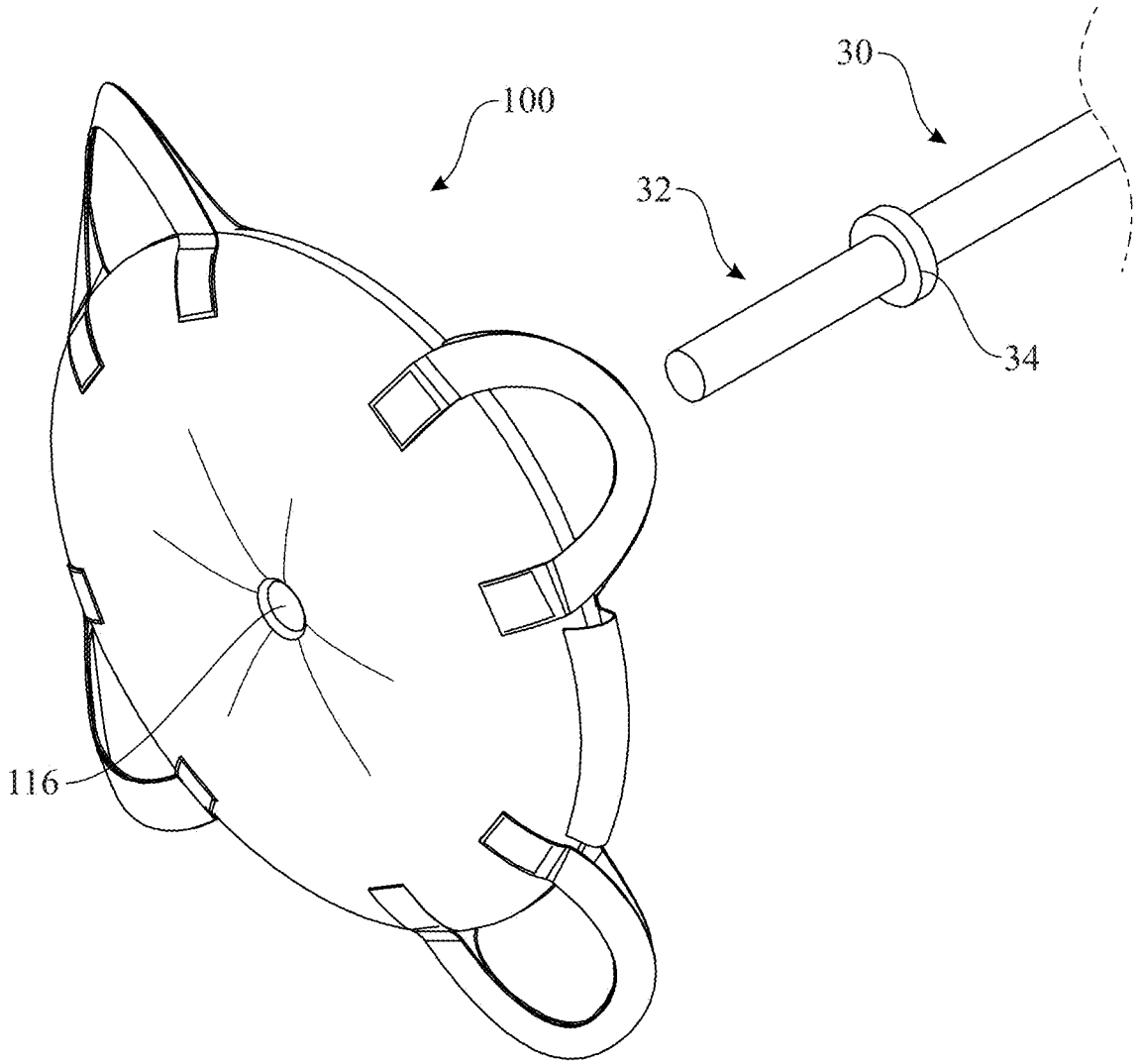
FIG. 4 presents a front perspective view showing how a barbell is inserted through a central aperture of the weight assembly according to the first embodiment of the present invention.
Figure 5:
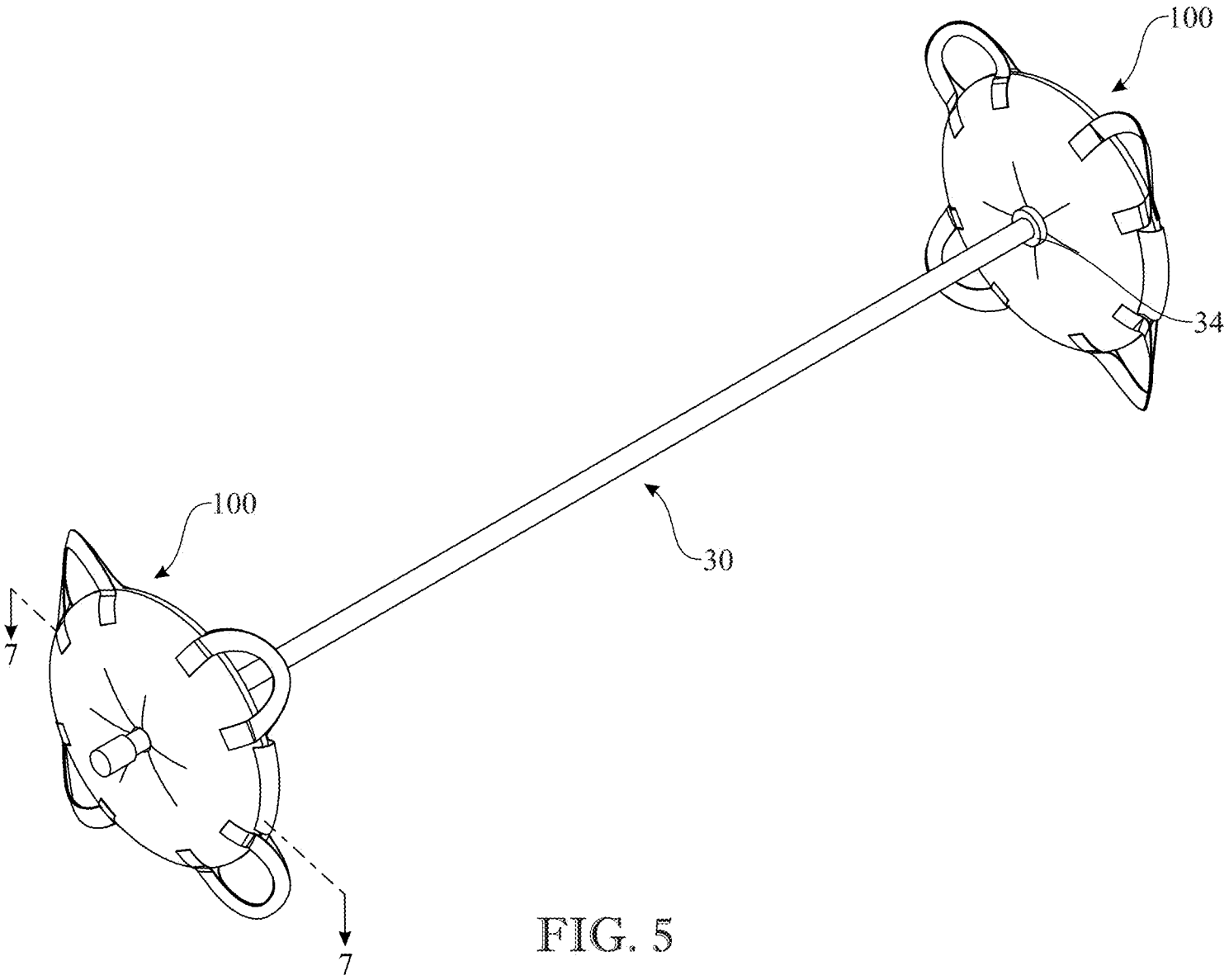
FIG. 5 presents an upper perspective view showing a loaded barbell fitted with a set of disk plates each configured according to the first embodiment of the weight assembly of the present invention, a process originally shown in FIG. 4.
Figure 6:
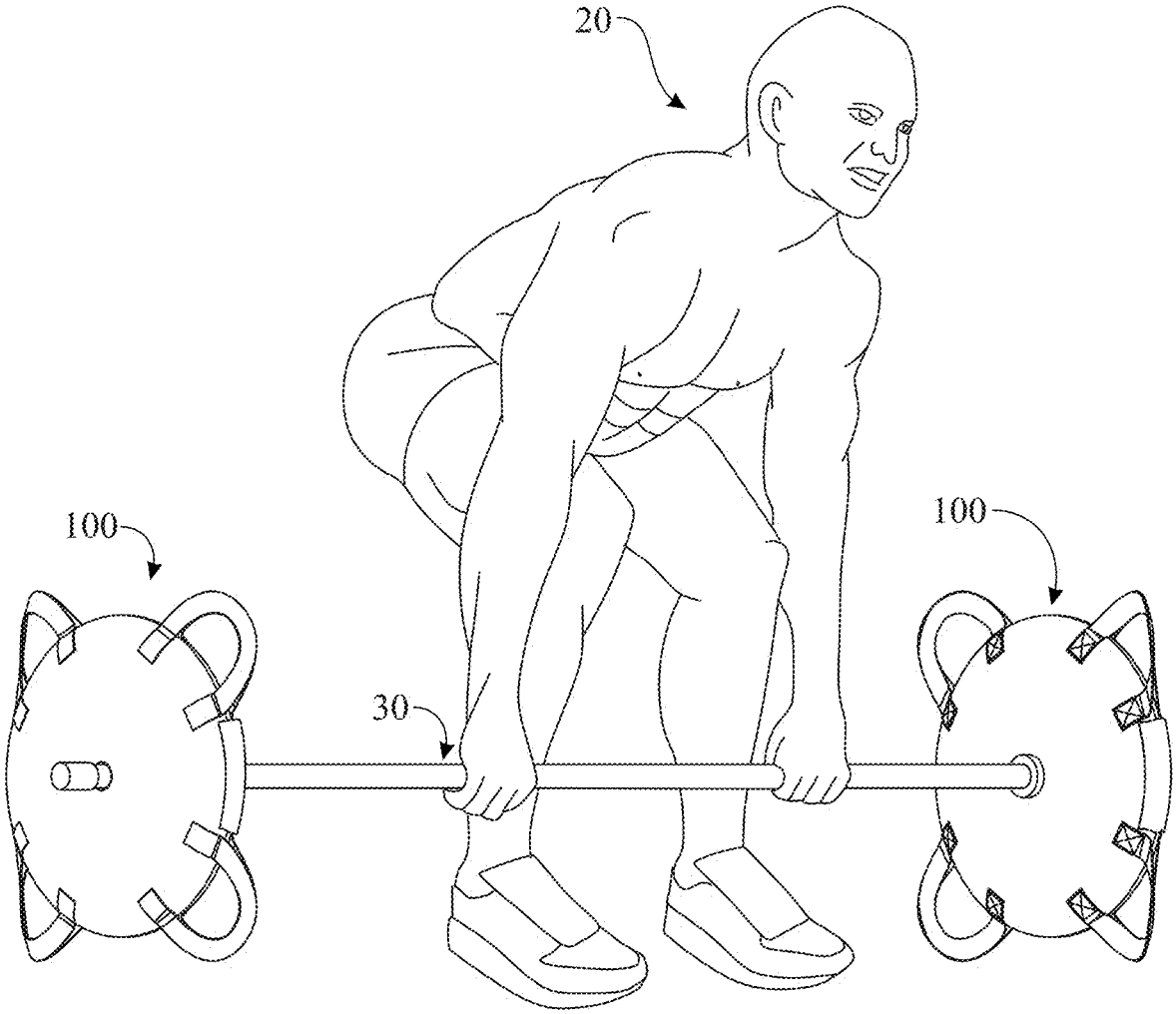
FIG. 6 presents a front perspective view showing a user in the set-up or starting position of a deadlift weight training exercise using the loaded barbell originally disclosed in FIG. 5.

Referring now to FIGS. 3-6, the operation, use, and application of weight assembly 100 is disclosed, according to the first embodiment of the present invention. The weight assembly 100 can be used individually or in pairs. FIG. 3 refers to the use of weight assembly 100 as a hand-held free weight, while FIGS. 4-6 refer to the use of weight assembly 100 in a barbell arrangement. Referring to FIG. 3, a user exercises with a separate weight assembly 100 in each hand, holding the weight assembly 100 by one of the handles 102. In this position, each weight assembly 100 functions as an independent weight-lifting object. As used in FIG. 3, the weight assembly 100 functionally resembles a kettlebell, but, in addition to its different structure, is much more versatile because its weight is variably adjustable (depending on the amount of sand added as fill material) and it has multiple carrying or holding points due to the array of peripheral handles 102. Referring to FIGS. 4-6, the plate-carrying end 32 of a conventional barbell 30 is inserted through the central aperture 116 of weight assembly 100, placing assembly 100 in a conventional barbell position secured by any conventional means, such as end cap 36 and a stop collar or sleeve 34. The other opposite end of barbell 30 is similarly configured to carry another weight assembly 100, yielding the loaded barbell arrangement shown in FIG. 5. A user 20 can then interact with the loaded barbell arrangement according to any conventional fitness activity known to those skilled in the art (FIG. 6).

The present invention offers various benefits, improvements and advantages. The weight assembly 100 enables a user to variably adjust the weight since each compartment space 132 can be selectively filled with a desired amount of contents. The design of weight assembly 100 allows each compartment space 132 to be filled, emptied, and re-filled based on the desired overall weight. The structural parts of the weight assembly 100 have a flexibility that accommodates and otherwise facilitates a wide range of weight loading. The shell 110, made of matching half-section 112*a, b*, is preferably made of a material construction that supports flexing and stretching in response to varying amounts of sand loaded into the compartment spaces 132. This plasticity feature enables the weight assembly 100 to be loaded and otherwise occupied by a variable amount of mass, which distinguishes it from conventional weight plates that have fixed, static poundage. Additionally, the preferred elasticity of shell 110 allows it to retain and be restored to its original shape when the load is removed (e.g., sand is emptied from the compartment spaces 132). The weight assembly 100 can essentially function as an all-in-one weight set since it can be variably loaded with a range of weight amounts. The adjustment to a new weight is simply made by changing the contents of the compartment spaces 132 to match the desired weight (e.g., placing the correct amount of sand in each compartment space 132).

The unloaded version of weight assembly 100 can be packaged into a compact structure due to the flexible characteristics of shell 110 and the set of individual partitions 130*a*. During loading of compartment space 132, the adjacent mesh partitions 130*a,b* defining the boundaries of compartment space 132 assume their deployed shape as contents are loaded into compartment space 132.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. An exercise weight assembly, comprising:

a hollow shell including a pair of opposing half sections cooperatively defining an interior enclosure space;

a central aperture formed in the hollow shell;

a plurality of spaced-apart partition elements disposed in the interior enclosure space, each partition element of the plurality of partition elements having a mesh construction; and a plurality of compartment spaces each defined by an adjacent pair of partition elements of the plurality of spaced-apart partition elements, each compartment space of the plurality of compartment spaces being isolated from an adjacent pair of compartment spaces of the plurality of compartment spaces, wherein each partition element of the plurality of spaced-apart partition elements extends in a radial direction from an inner radial end thereof proximate the central aperture to an outer radial end thereof proximate a radial periphery of the hollow shell, wherein the plurality of spaced-apart partition elements are each equidistant from one another, wherein the plurality of spaced-apart partition elements each extend between the pair of opposing half sections within the enclosure space, wherein opposite sides of each partition element of the plurality of spaced-apart partition elements are attached to the pair of opposing half sections of the hollow shell, respectively, and wherein the plurality of partition elements include a rectangular construction, and wherein the hollow shell and each partition element of the plurality of partition elements has a flexible construction, and wherein the exercise weight assembly has (i) a packed state in which each compartment space of the plurality of compartment spaces is unloaded and the exercise weight assembly is packaged into a compact structure and (ii) a deployed state in which one or more compartment spaces of the plurality of compartment spaces are loaded with a respective amount of weighted material independently from other compartment spaces of the plurality of compartment spaces for enabling an overall weight of the exercise weight assembly to be variably adjusted.

2. The exercise weight assembly of claim 1, wherein a plurality of slots are provided at the radial periphery of the hollow shell, wherein each compartment space of the plurality of compartment spaces is associated with a respective slot of the plurality of slots, each compartment space of the plurality of compartment spaces configured to be loaded with a respective amount of the weighted material through the respective slot.

3. The exercise weight assembly of claim 2, wherein each slot of the plurality of slots gives access into the interior enclosure space for emptying a selected amount of the weighted material from the respective compartment space of the plurality of compartment spaces.

4. The exercise weight assembly of claim 1, wherein each compartment space of the plurality of compartment spaces is selectively loadable with weighted material.

5. The exercise weight assembly of claim 1, wherein the hollow shell is made out of reinforced material capable of supporting and retaining the weighted material therein.

6. The exercise weight assembly of claim 1, wherein at least one handle is disposed proximate the radial periphery of the hollow shell.

7. The exercise weight assembly of claim 1, wherein variable loading of the weighted material into each compartment space of the plurality of compartment spaces creates a weight plate having a weight dependent on the loading of the weighted material.

8. An exercise weight assembly, comprising:

a hollow shell including a pair of opposing half sections cooperatively defining an interior enclosure space;

a central aperture formed in the hollow shell;

a plurality of radially extending, circumferentially spaced-apart partition elements disposed in the interior enclosure space and extending between the pair of opposing half sections, each partition element of the plurality of partition elements having a mesh construction;

a plurality of compartment spaces each defined by a circumferentially adjacent pair of the plurality of partition elements, each compartment space of the plurality of compartment spaces being isolated from an adjacent pair of compartment spaces of the plurality of compartment spaces;

wherein each partition element of the plurality of partition elements extends in a radial direction from an inner radial end thereof proximate the central aperture to an outer radial end thereof proximate a radial periphery of the hollow shell, and wherein the plurality of partition elements include a rectangular construction; and a plurality of slots provided at the radial periphery of the hollow shell, wherein each compartment space of the plurality of compartment spaces is associated with a respective slot of the plurality of slots, each compartment space of the plurality of compartment spaces configured to be loaded with a respective amount of weighted material through the respective slot independently from other compartment spaces of the plurality of compartment spaces for enabling an overall weight of the exercise weight assembly to be variably adjusted.

9. The exercise weight assembly of claim 8, wherein each compartment space of the plurality of compartment spaces is selectively loadable with sand independently from other compartment spaces of the plurality of compartment spaces via the respective slot of the plurality of slots.

10. The exercise weight assembly of claim 8, wherein variable loading of the weighted material is loadable into each compartment space of the plurality of compartment spaces to create a weight plate of a certain weight, wherein a weight of the weight plate is dependent on an amount of the weighted material loaded into the plurality of compartment spaces.

11. The exercise weight assembly of claim 8, wherein each slot of the plurality of slots gives access into the interior enclosure space for emptying a selected amount of the weighted material from the respective compartment space of the plurality of compartment spaces.

12. The exercise weight assembly of claim 8, wherein a plurality of handles are circumferentially disposed proximate to the radial periphery of the hollow shell.

13. An exercise weight assembly, comprising:

a disc-shaped, hollow shell including a pair of opposing half sections cooperatively defining an interior enclosure space;

a central aperture formed in the hollow shell;

a plurality of radially extending, circumferentially spaced-apart partition elements disposed in the interior enclosure space and extending between the pair of opposing half sections;

a plurality of compartment spaces each defined by a circumferentially adjacent pair of the plurality of partition elements, each compartment space of the plurality of compartment spaces being isolated from an adjacent pair of compartment spaces of the plurality of compartment spaces;

a plurality of slots provided at a radial periphery of the hollow shell, wherein each compartment space of the plurality of compartment spaces is associated with a respective slot of the plurality of slots, each compartment space of the plurality of compartment spaces configured to be loaded with a respective amount of weighted material through the respective slot independently from other compartment spaces of the plurality of compartment spaces for enabling an overall weight of the exercise weight assembly to be variably adjusted; and at least one handle disposed at the radial periphery of the hollow shell, wherein each partition element of the plurality of partition elements has a mesh construction that extends in a radial direction from an inner radial end thereof proximate the central aperture to an outer radial end thereof proximate the radial periphery of the hollow shell, and wherein the plurality of partition elements include a rectangular construction, and wherein the hollow shell and each partition element of the plurality of partition elements has a flexible construction, and wherein the exercise weight assembly has (i) a packed state in which each compartment space of the plurality of compartment spaces is unloaded and the exercise weight assembly is packaged into a compact structure and (ii) a deployed state in which one or more compartment spaces of the plurality of compartment spaces are loaded with a respective amount of the weighted material independently from other compartment spaces of the plurality of compartment spaces for enabling an overall weight of the exercise weight assembly to be variably adjusted.

* * * * *